United States Patent [19]

Sanvito

[11] Patent Number: 4,612,866

[45] Date of Patent: Sep. 23, 1986

[54] SEWING MACHINE WITH A BRIDGE-TYPE STRUCTURE

[75] Inventor: Roberto Sanvito, Milan, Italy

[73] Assignee: Rockwell-Rimoldi, S.p.A., Italy

[21] Appl. No.: 717,614

[22] Filed: Mar. 29, 1985

[30] Foreign Application Priority Data

Jun. 15, 1984 [IT] Italy ..... 22312/84[U]

[51] Int. Cl.[4] ..... D05B 25/00

[52] U.S. Cl. ..... 112/155; 112/167

[58] Field of Search ..... 112/155, 163, 165, 166, 112/167

[56] References Cited

U.S. PATENT DOCUMENTS

| | | | |
|---|---|---|---|
| 417,146 | 12/1889 | Chandler | 112/166 |
| 913,598 | 2/1909 | White | 112/167 |
| 1,578,324 | 3/1926 | Klav | 112/155 |
| 1,704,009 | 3/1929 | Lehmann | 112/167 |
| 4,043,283 | 8/1977 | Jung | 112/163 |

FOREIGN PATENT DOCUMENTS

| | | | |
|---|---|---|---|
| 767431 | 9/1967 | Canada | 112/155 |

*Primary Examiner*—Wm. Carter Reynolds

[57] ABSTRACT

A sewing machine is provided which is composed of two halves, each having sewing instrumentalities, a single, splined drive shaft and having an adjustment mechanism for connecting the two halves together so that the distances between the sewing instrumentalities can be varied.

1 Claim, 4 Drawing Figures

SEWING MACHINE WITH A BRIDGE-TYPE STRUCTURE

BACKGROUND OF THE INVENTION

The present invention relates to a so-called bridge-type sewing machine provided with a top section carrying two needle rods which are located at a distance from each other and operated by a single shaft and with two opposite bottom sections which are located at a distance from each other and contain the lower sewing elements which cooperate with the said needle rods in order to stitch the opposite edges of articles to be made in various widths.

A sewing machine of this type, described in a pending U.S. application Ser. No. 518,279 assigned to the same Assignee as the present invention, is already known, in which the article can be freely placed in the space formed between the said bottom sections so that its opposite edges are gradually fed through under the needles mounted on the needle rods. According to the abovementioned application, it is also possible to vary the distance between the bottom sections located opposite each other, so that the article can be suitably accommodated in the said space formed between the bottom sections: for example, in the case of articles of large thickness, the distance between the bottom sections must be increased and at the same time both the needle rods and the lower sewing elements must be separated from each other by the same amount. For this purpose, provision is made, according to the abovementioned patent application, for an element which can be inserted between the two parts forming the top section of the sewing machine, in the plane of symmetry between the needle rods, such that both the needle rods and the lower sewing elements can be separated from each other by an amount equal to the thickness of the inserted element.

With this solution, a series of elements would obviously have to be inserted in order to adjust the distance between the bottom sections. This would undoubtedly give rise to a complicated procedure for obtaining correct adjustment, in addition to the inconvenience of having to keep these elements in a safe place, since, once removed, they could be misplaced.

The object of the present invention is precisely to design a sewing machine of the type described above, the features of which are such that it is possible to increase easily the distances between the bottom sections from a minimum value to a maximum value, passing through an infinite number of intermediate distances, and which is particularly efficient and practical as regards operation such that the abovementioned drawbacks can be overcome.

DESCRIPTION OF DRAWINGS

The solution is obtained by means of the measures referred to in the following description which is given purely by way of a non-limiting example of the scope of the present invention and which is illustrated in the attached drawings in which.

DESCRIPTION OF THE INVENTION

Figure 1:
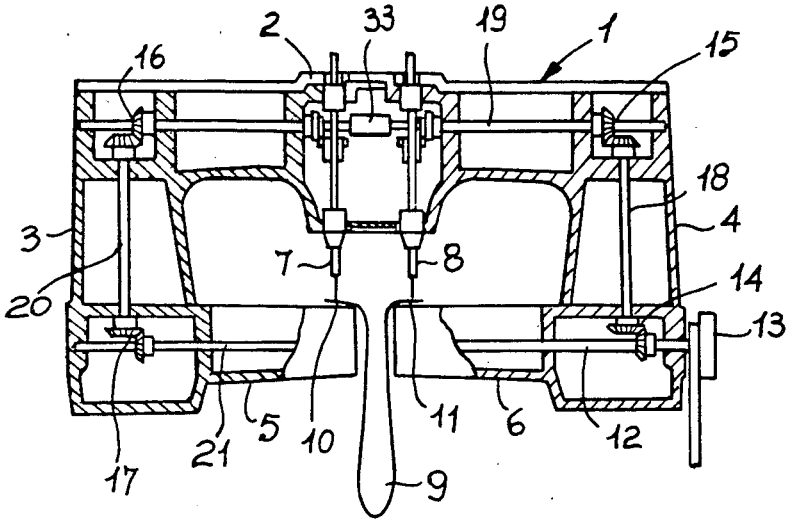
FIG. 1 is a schematic cross-section of a sewing machine according to the invention.
Figure 3:
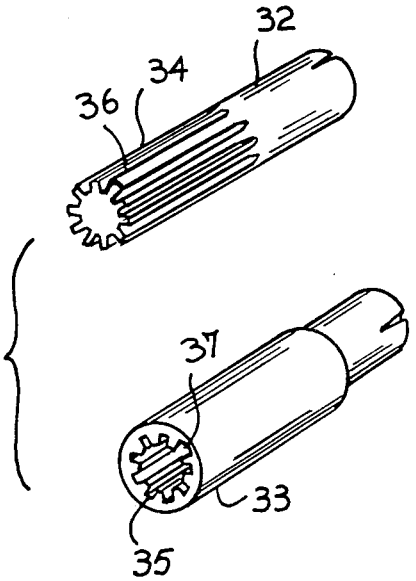
FIG. 3 shows a perspective view of certain parts of the sewing machine in question.

With reference in particular to FIG. 1, the housing 1 of the sewing machine in question consists of the top section 2 connected to two columns 3 and 4 which are in turn fixed to the bottom sections 5 and 6, respectively, located opposite each other.

The top section 2 carries the two needle rods 7 and 8 to which one or more needles are fixed, the latter cooperating, in order to form the stitches, with the hooks and feed devices, these means which are not visible in the figures, but are known, being mounted in the bottom sections 5 and 6.

The hooks and feed devices form, as is known, the lower sewing elements. The said bottom sections 5 and 6 are located at a distance from each other such that the article 9 to be sewn can be freely placed in the space formed between the said bottom sections so that its edges 10 and 11 are aligned with the needles mounted on the needle rods 7 and 8, respectively.

The mechanism for operating the various sewing elements, which consist of the needle rods 7 and 8 and of the hooks and feed devices not shown, is driven by a main shaft 12 fixed to the handwheel 13 which, in turn, is connected in a known manner to an electric motor not shown in the figures.

The pairs of bevel gears 14, 15, 16 and 17 transmit the movement from the shaft 12 to the shafts 18, 19, 20 and 21, respectively, which in turn transmit the movement to the needle rods 7 and 8 and to the hooks and feed devices not shown.

Figure 2:
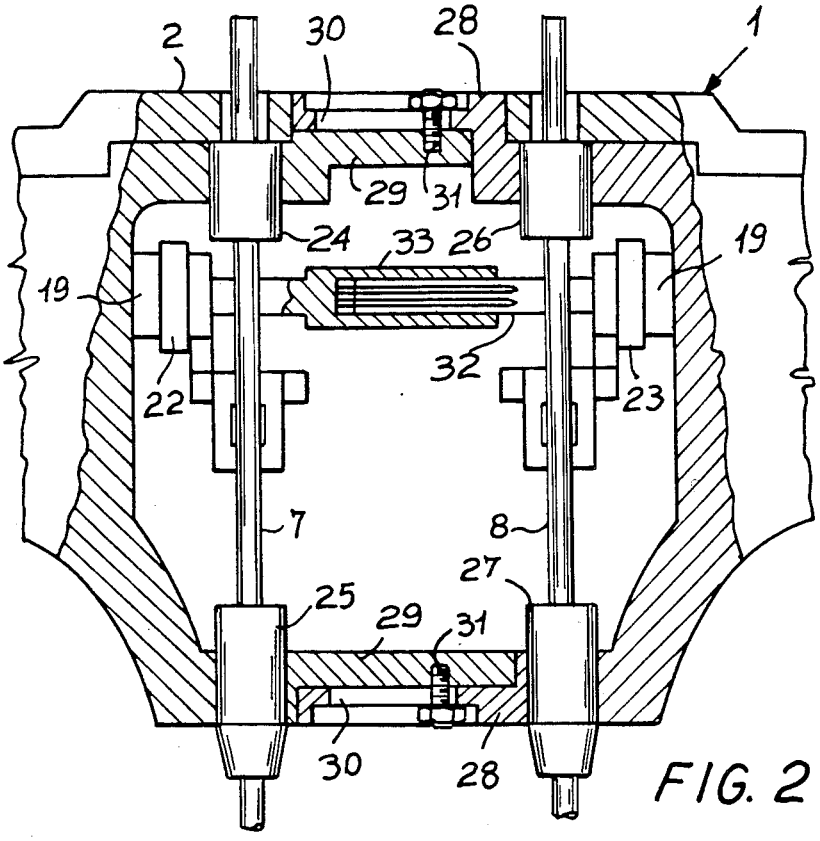
FIG. 2 shows an enlarged portion of FIG. 1.
Figure 4:
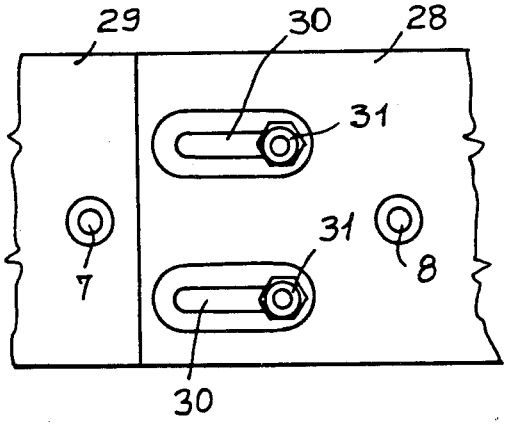
FIG. 4 shows a top plan view of FIG. 2.

The said needle rods 7 and 8, as can be more clearly seen from the enlarged drawing of FIG. 2, are connected to the shaft 19 by means of two known kinematic mechanisms 22 and 23, respectively, which transform the rotary motion of the shaft 19 into the vertical alternating movement of the needle rods 7 and 8 which slide in the bushings 24, 25, 26 and 27, respectively.

According to the new features of the present invention, the top section 2, in the zone lying between the needle rods 7 and 8, is divided into two parts 28 and 29, provided with adjusting means which are located both at the top and at the bottom of the top section 2 and consist of the guide slots 30 provided in the part 28 and of the locking screws 31 mounted on the part 29.

The shaft 19 is constructed in two parts and is formed with coaxial mating end parts 32 and 33 to provide connecting means consisting, respectively, of a grooved area 34 on the outside and of a grooved area 35 on the inside. By this means the two parts are permanently locked during rotation of the shaft 19, but are also able to slide axially relative to each other.

With the distance between the bottom sections 5 and 6 needs to be varied, the screws 31 are loosened and the parts 28 and 29 are slid relative to each other until the abovementioned bottom sections are in the desired position in accordance with the thickness of the article to be sewn.

At the same time, the end parts 32 and 33 of the shaft 19 slide relative to each other, and the needle rods 7 and 8 are separated from each other by a corresponding distance, together with the lower sewing elements. When the desired position of the bottom sections 5 and 6 has been obtained, as described above, the screws 31 are tightened so that the parts 28 and 29 are fixed to each other as though the top section 2 consisted of a single piece.

It must be noted that the tooth 36 between two grooves in the grooved area 34 on the outside is designed to be larger than the other teeth so that it engages with only one groove 37 in the grooved area 35 on the inside, in a position such that the two parts 32 and 33 of the shaft 19 are always in the same angular position so that the needle rods and the lower sewing elements are synchronized with respect to each other.

The above description relates to an exemplary embodiment of the invention and it is therefore understood that variations and modifications can be made to the said embodiment without going outside the protective scope of the invention, the new features of which are described in the claims which follow.

I claim:

1. A sewing machine with a bridge-type structure, provided with a top section carrying two needle rods which are located at a distance from each other and operated by a single two piece shaft located within the top section and with two opposite bottom sections which are located at a distance from each other and contain the lower sewing elements which cooperate with the said needle rods in order to form the stitches, the said top section, in the zone lying between the needle rods, being divided into two parts provided with adjusting means designed to enable one part to slide relative to the other and designed to fix the said parts in the required position with consequent variation in the distance between the needle rods and the bottom sections, wherein said shaft is provided with coaxial, mating connecting means consisting of a grooved area defining teeth on the outside of one of said two shaft pieces and of a grooved area defining teeth on the inside of the other one, such that said two grooved pieces enable the length of the shaft itself to be varied when the distance between the needle rods is varied, and wherein one tooth of said outer grooved piece is larger than the other teeth and is designed to engage in a correspondingly sized groove of said inner grooved piece in a position such that the angular position of the two pieces forming the single two piece shaft remains unvaried.

* * * * *